US006430778B1

(12) United States Patent
King

(10) Patent No.: US 6,430,778 B1
(45) Date of Patent: Aug. 13, 2002

(54) APPARATUS FOR HINGEDLY CONNECTING A CABINET DOOR TO A CABINET WALL OF A FRAMELESS CABINET

(76) Inventor: Ron E. King, 1545 River Park Dr. Suite 450, Sacramento, CA (US) 95815

( * ) Notice: Subject to any disclaimer, the term of this patent is extended or adjusted under 35 U.S.C. 154(b) by 0 days.

(21) Appl. No.: 09/542,994

(22) Filed: Apr. 4, 2000

Related U.S. Application Data

(60) Provisional application No. 60/129,102, filed on Apr. 13, 1999.

(51) Int. Cl.[7] ..... E05D 5/00
(52) U.S. Cl. ..... 16/382; 312/326
(58) Field of Search ..... 16/271, 272, 382, 16/235–237; 312/326–329

(56) References Cited

U.S. PATENT DOCUMENTS

| | | | | |
|---|---|---|---|---|
| 2,504,749 A | * | 4/1950 | Stepacoff et al. | 88/53 |
| 3,524,216 A | * | 8/1970 | Fernandez et al. | 16/128 |
| 3,590,419 A | * | 7/1971 | Dargene | 16/135 |
| 4,159,557 A | * | 7/1979 | Pittasch et al. | 16/129 |
| RE30,717 E | | 8/1981 | Dargene | 16/135 |
| 4,517,706 A | | 5/1985 | Lautenschläger et al. | 16/238 |
| 4,615,072 A | | 10/1986 | Lautenschläger, Jr. et al. | 16/238 |
| 4,698,877 A | | 10/1987 | Lautenschläger, Jr. et al. | 16/235 |
| 4,703,539 A | | 11/1987 | Lautenschläger, Jr. et al. | 16/240 |
| 4,704,766 A | | 11/1987 | Almestad | 16/236 |
| 4,777,777 A | * | 10/1988 | Massimo | 52/586 |
| 4,799,290 A | | 1/1989 | Lautenschläger, Jr. et al. | 16/237 |
| 4,856,141 A | | 8/1989 | Sassenberg | 16/250 |
| 4,976,006 A | | 12/1990 | Lautenschläger | 16/238 |
| 5,052,077 A | | 10/1991 | Lautenschläger, Jr. et al. | 16/238 |
| 5,067,200 A | | 11/1991 | Stowell et al. | 16/237 |
| 5,103,532 A | | 4/1992 | Youngdale et al. | 16/288 |
| 5,108,165 A | | 4/1992 | Rorke et al. | 312/322 |
| 5,327,616 A | | 7/1994 | Lautenschläger, Jr. et al. | 16/382 |
| 5,375,297 A | | 12/1994 | Lautenschläger, Jr. et al. | 16/249 |
| 5,392,493 A | | 2/1995 | Youndale | 16/237 |
| 5,511,287 A | | 4/1996 | Lautenschläger, Jr. et al. | 16/239 |
| 5,577,296 A | | 11/1996 | Grass | 16/258 |
| RE36,213 E | | 6/1999 | Lautenschläger, Jr. et al. | 16/249 |
| 6,163,930 A | * | 12/2000 | King | 16/382 |

FOREIGN PATENT DOCUMENTS

DE 4405349 A1 8/1995

OTHER PUBLICATIONS

Charles McMurray Catalog pp. 93 and 112–114.

* cited by examiner

*Primary Examiner*—Lynne H. Browne
*Assistant Examiner*—John B. Walsh
(74) *Attorney, Agent, or Firm*—Thomas R. Lampe

(57) ABSTRACT

Apparatus for hingedly connecting a cabinet door to a cabinet wall of a frameless cabinet includes a hinge member affixed to an elongated support plate. The elongated support plate is inserted into an elongated recess extending from the wall front of the cabinet wall. Projections on the support plate engage the cabinet wall at the location of the elongated recess to retain the support plate and attached hinge member on the cabinet wall.

11 Claims, 3 Drawing Sheets

APPARATUS FOR HINGEDLY CONNECTING A CABINET DOOR TO A CABINET WALL OF A FRAMELESS CABINET

This application is based on and claims the benefit of U.S. Provisional Application No. 60/129,102, filed Apr. 13, 1999.

TECHNICAL FIELD

This invention relates to frameless cabinets and more particularly to apparatus for connecting a cabinet door to a cabinet wall of a frameless cabinet.

BACKGROUND OF THE INVENTION

Frameless cabinet constructions having cabinet walls with doors hingedly connected thereto are well known. German Offenlegungsschrift DE 4405349A1 discloses a structural wall having a recess extending from a front opening into the interior of the wall. The recess communicates with a slot formed in a wall side. A hinge member having flanges is connected to the wall structure by positioning the flanges in the recess and the hinge member per se in the slot communicating with the recess.

U.S. Pat. No. 5,067,200, issued Nov. 26, 1991, shows a hinge suitable for use with cabinets having inset doors. The hinge can be installed and adjusted on the door at the installation site. The hinge has hinge wings which are concealed when the door is in the closed position. The hinge includes a clamping plate parallel to a leg of a door wing engageable in a slot in the slotted edge of the door.

The following prior art also is known and believed representative of the current state of the prior art: U.S. Pat. No. 4,703,539, issued Nov. 3, 1987, U.S. Pat. No. 5,511,287, issued Apr. 30, 1996, U.S. Pat. No. 4,799,290, issued Jan. 24, 1989, U.S. Pat. No. 4,856,141, issued Aug. 15, 1989, U.S. Pat. No. 5,327,616, issued Jul. 12, 1994, U.S. Pat. No. 5,375,297, issued Dec. 27, 1994, U.S. Pat. No. 5,108,165, issued Apr. 28, 1992, U.S. Pat. No. RE.36,213, issued Jun. 1, 1999, U.S. Pat. No. RE.30,717, issued Aug. 25,1981, U.S. Pat. No. 5,052,077, issued Oct. 1, 1991, U.S. Pat. No. 4,615,072, issued Oct. 7, 1986, U.S. Pat. No. 4,517,706, issued May 21, 1985, U.S. Pat. No. 4,698,877, issued Oct. 13, 1987, U.S. Pat. No. 5,392,493, issued Feb. 28, 1995, U.S. Pat. No. 5,577,296, issued Nov. 26, 1996, U.S. Pat. No. 5,103,532, issued Apr. 14, 1992, U.S. Pat. No. 4,704,766, issued Nov. 10, 1987, and U.S. Pat. No. 4,976,006, issued Dec. 11, 1990. A frameless cabinet door hinge is closed in German Offenlegungsschrift DE 4405349A1. Other hinges of some degree of relevance are shown in pages 93 and 112–114 of the 1998 Charles McMurray Catalog.

The prior art indicated above does not teach or suggest the invention disclosed and claimed herein.

DISCLOSURE OF INVENTION

The present invention is directed to apparatus for hingedly connecting a cabinet door to a cabinet wall of a frameless cabinet. The apparatus is characterized by its simplicity and relatively low cost. Furthermore, the resultant construction is very strong and will fail only when very high forces, including hinge "bend back" forces, are applied to the cabinet door. This is accomplished by distributing such forces to a substantial area of the cabinet wall, enabling the cabinet incorporating the apparatus to be constructed of materials of lesser strength or having smaller dimensions than possible with known prior art approaches. This results not only in a cost savings but also a more efficient use of natural resources. For example, employing the techniques of the present invention a narrow panel of fiberboard can be utilized as the cabinet wall. Tests have shown that a one-half inch fiberboard panel and the apparatus of the present invention combine to form an extremely strong structure. This is not the case when conventional prior art hinge structures are employed with such material. Of course, the teachings of the invention can be employed with other cabinet wall thicknesses and materials.

The apparatus of the present invention is for hingedly connecting a cabinet door and a cabinet wall of a frameless cabinet, the cabinet wall including spaced wall sides and a wall front extending between the spaced wall sides. The cabinet wall defines an opening at the wall front and an elongated recess extending inwardly from the opening into the cabinet wall between the wall sides.

The apparatus includes a first hinge member for attachment to a cabinet door and a second hinge member pivotally connected to the first hinge member.

A double-ended, elongated support plate is affixed to the second hinge member at one of the ends of the elongated support plate for positioning through an opening in the wall front of a cabinet wall of a frameless cabinet into an elongated recess extending inwardly from the opening and between the wall sides of the cabinet wall, the elongated support plate having a support plate top and a support plate bottom.

At least one projection is attached to the elongated support plate for frictionally engaging the cabinet wall when the elongated support plate is in the elongated recess of the cabinet wall to attach the second hinge member to the cabinet wall.

Other features, advantages, and objects of the present invention will become apparent with reference to the following description and accompanying drawings.

MODES FOR CARRYING OUT THE INVENTION

Figure 1:
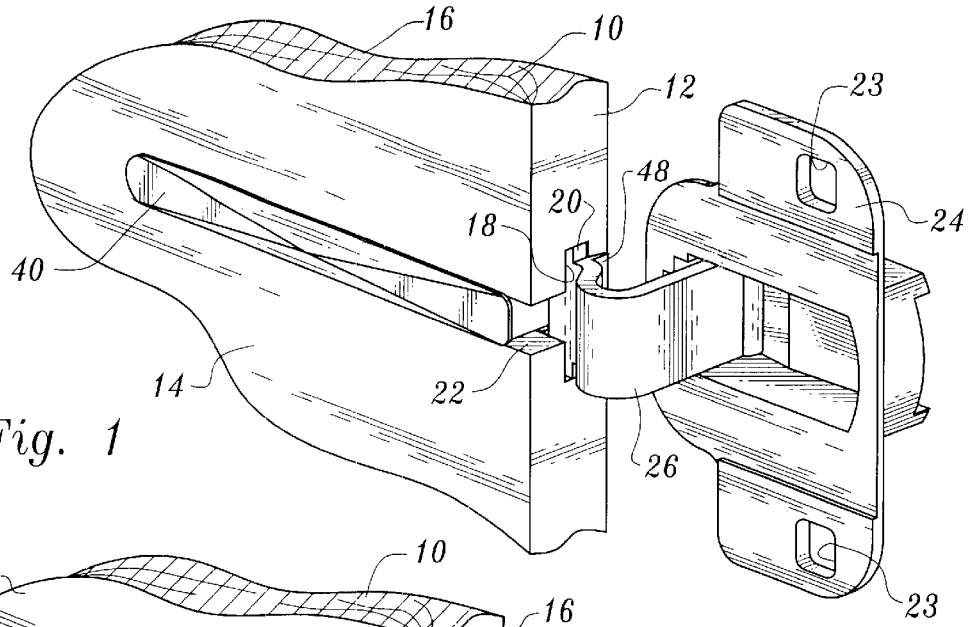
FIG. 1 is a perspective view illustrating apparatus constructed in accordance with the teachings of the present invention attached to a cabinet wall of a frameless cabinet, only a portion of the cabinet wall being illustrated.

Referring now to FIGS. 1–6, a preferred form of apparatus constructed in accordance with the teachings of the present invention is illustrated. The apparatus is for hingedly connecting a cabinet door to a cabinet wall 10 of a frameless cabinet. The cabinet wall 10 (shown in FIGS. 1 and 2) includes a wall front 12 extending between spaced wall sides 14 and 16. The cabinet wall defines an opening 18 at the wall front and an elongated recess 20 extending inwardly from the opening into the cabinet wall between the wall sides. An elongated slot 22 is formed in wall side 14 and communicates with the larger elongated recess 20.

Figure 4:
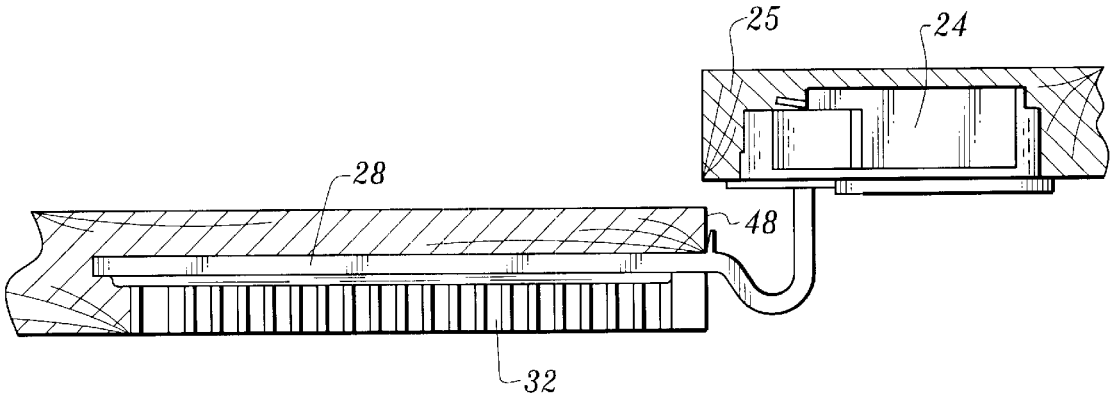
FIG. 4 is a top plan view of the apparatus without the cover plate supporting a door on a cabinet wall.
Figure 5:
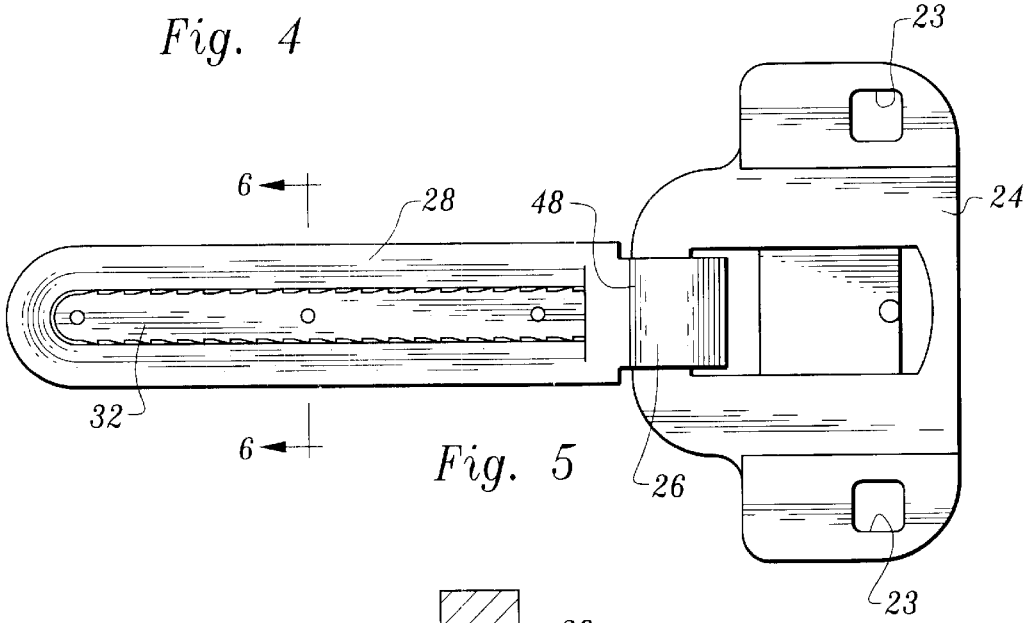
FIG. 5 is a side elevational view of the apparatus without the cover plate.
Figure 6:
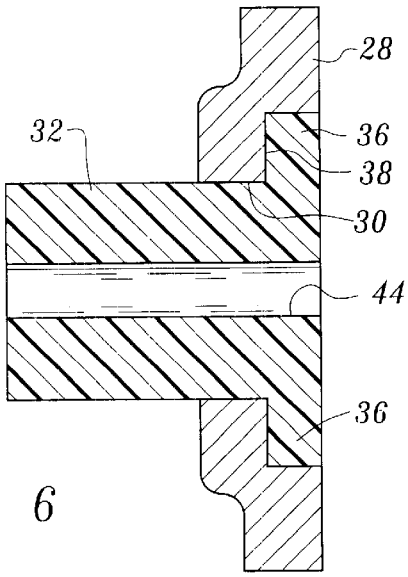
FIG. 6 is an enlarged, cross-sectional view taken along the line 6—6 in FIG. 5.

The disclosed hinge includes a first hinge member 24 for attachment to a cabinet door, a portion of which is shown in FIG. 4 and designated by reference number 25. The first hinge member 24 is of conventional construction, being of the cup-shaped type, except that it has enlarged mounting holes or openings 23 which receive screws or other mechanical fasteners used to attach the first hinge member to the door 25. The disclosed holes 23 are rectangular-shaped (squares with rounded corners) and are sized to allow relative movement between the shafts of the mechanical fasteners and first hinge member to allow adjustability during installation. When hinge member 24 is attached to the door 25 and a portion thereof is located in a recess formed in the door.

The hinge also includes a second hinge member 26 pivotally interconnected with the first hinge member. The principles of the present invention can be applied to a wide variety of hinge types and sizes.

Figure 2:
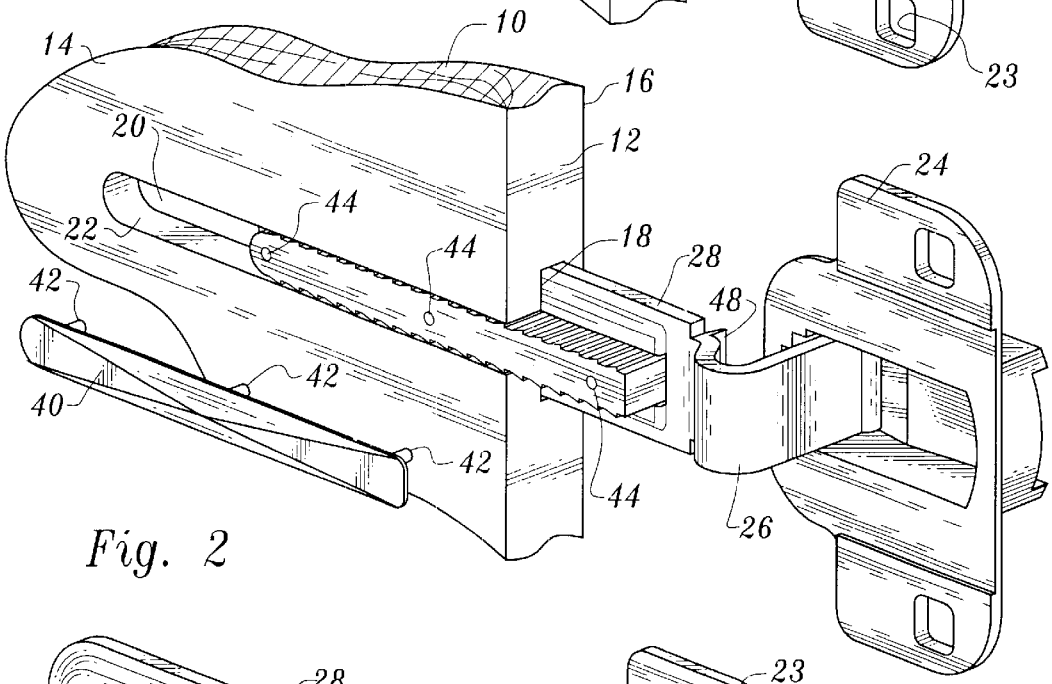
FIG. 2 is a perspective view illustrating the apparatus being installed on the cabinet wall, a cover plate being shown prior to attachment thereof to the rest of the apparatus.
Figure 3:
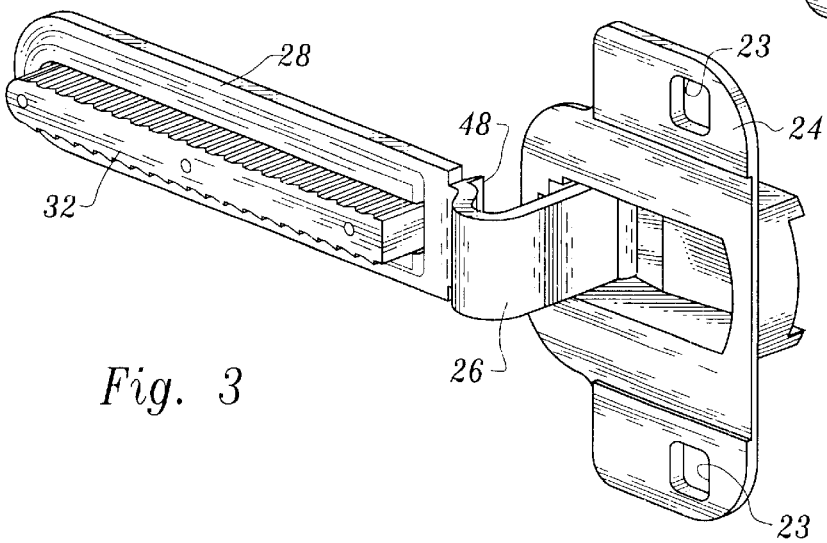
FIG. 3 is a perspective view of the apparatus without the cover plate.

A double-ended, elongated support plate 28 is affixed to the second hinge member at one of the ends of the support plate. The support plate is preferably at least 2 inches long and generally conforms to the dimensions of the elongated recess 20. FIG. 2 shows the elongated support plate 28 being inserted into the elongated recess 20.

Support plate 28 defines an elongated aperture 30 which receives an elongated rib 32. Rib 32 projects from a side of the support plate into elongated slot 22. A plurality of teeth project outwardly from the rib top and from the rib bottom, the teeth being angularly disposed so that insertion of the support plate and the rib into the elongated recess and the elongated slot of the cabinet wall is facilitated. The teeth engage the cabinet wall material at the top and bottom of the elongated slot 22. When an outwardly directed pulling force is exerted on the apparatus the angularly oriented teeth will "bite" into the material of the cabinet wall to resist removal of the elongated support plate from the elongated recess and removal of the elongated rib from the slot.

The rib has flanges 36 attached thereto and projecting therefrom. These flanges are positioned in a depression 38 formed in the support plate adjacent to the elongated aperture 30 so that a smooth outer surface is presented by the flanges, the rib and the support plate to facilitate placement thereof in the elongated recess.

Another component of the apparatus is a cover plate 40 (shown in FIGS. 1 and 2 only) having connector pins 42 projecting therefrom. After the support plate and rib have been installed on the cabinet wall, the pins 42 are positioned in holes 44 formed in the side of the rib. The cover plate 40 will be releasably retained in the position shown in FIG. 1 due to frictional engagement between the connector pins and the rib. The cover could carry a logo or other indicia.

An abutment 48 projects outwardly at the location where the support plate is joined to the second hinge member, the abutment engaging the wall front 12 to restrict the extent of movement of the elongated support plate into the elongated recess of the cabinet wall.

Figure 7:
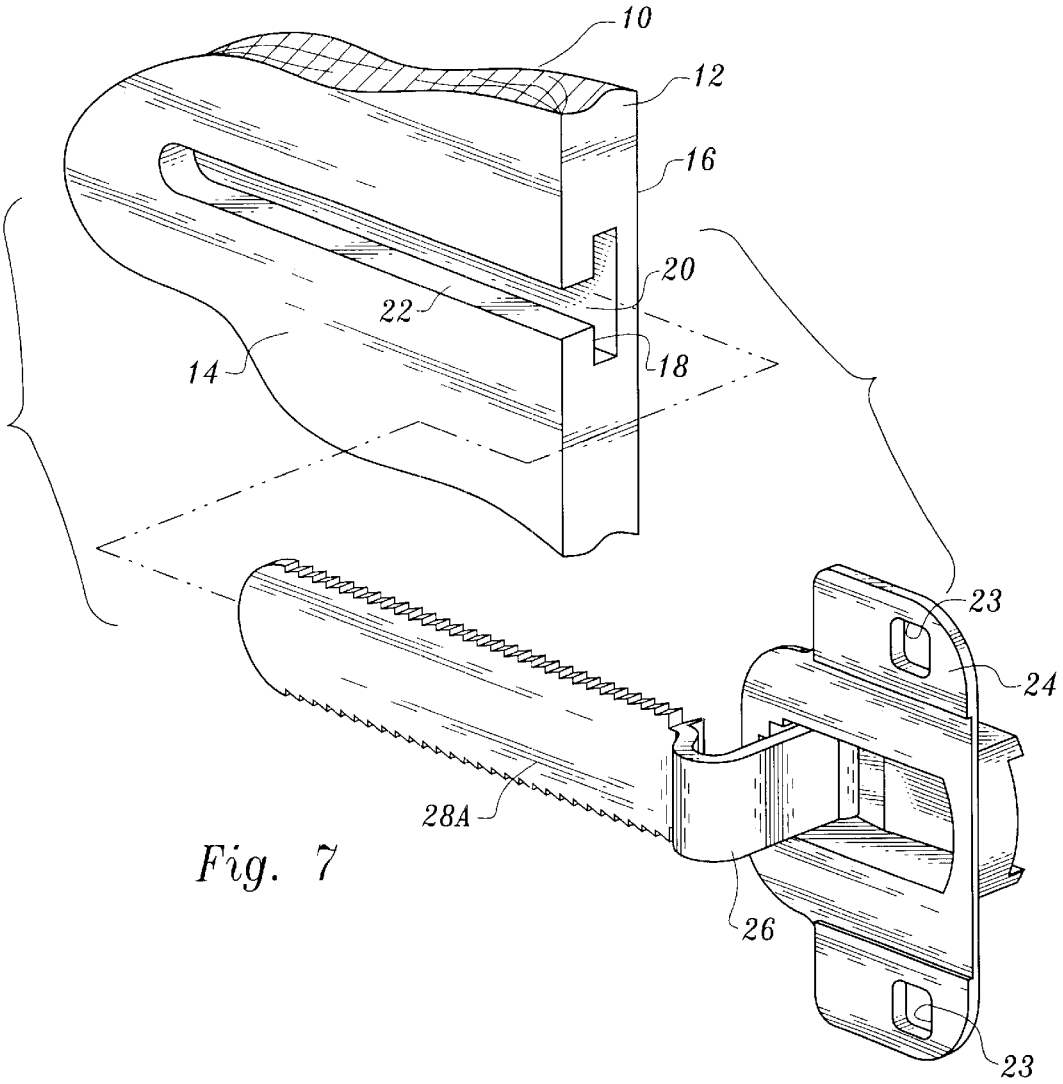
FIG. 7 is a perspective view of an alternative embodiment of the invention prior to its application to a cabinet wall.
Figure 8:
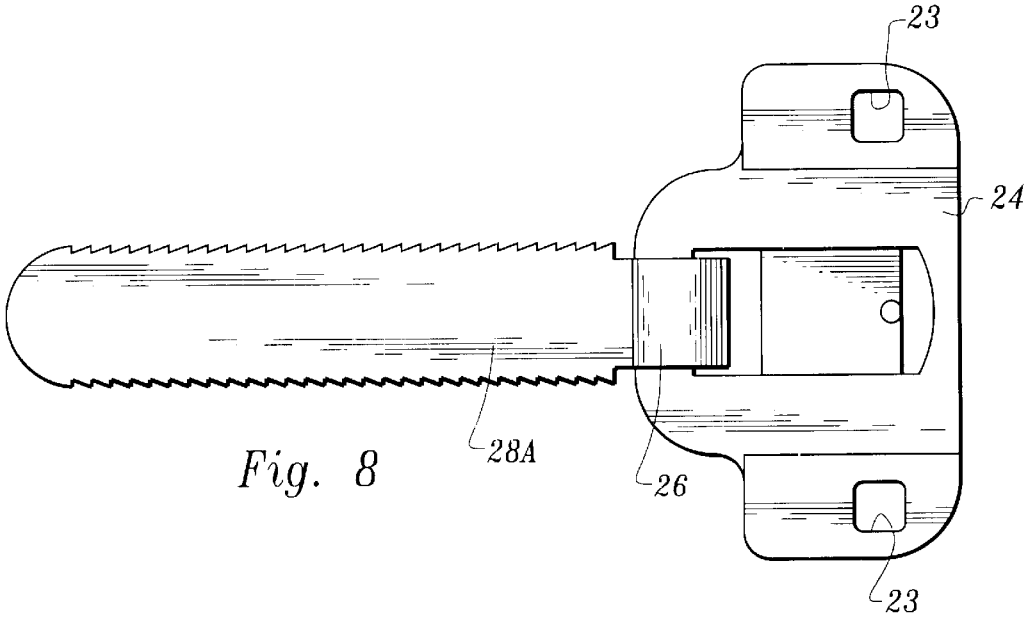
FIG. 8 is a side, elevational view of the embodiment of FIG. 7.

FIGS. 7 and 8 illustrate an alternative embodiment of the invention. The hinge members are of the same construction illustrated in FIG. 1–6 and the cabinet wall portion corresponds to that in those figures. The only difference between this second embodiment and the first embodiment described above is that the elongated support plate 28A forms no elongated aperture. Nor does a rib project therefrom.

Support plate 28A is in the nature of a flat plate fixedly secured to second hinge member 26. Angularly disposed teeth extend along the length of the support plate 28A at the top and bottom thereof.

Attachment of the second embodiment of the invention is simplicity itself, merely requiring the insertion of the elongated support plate into elongated recess 20, it being understood that the support plate 28 and teeth projecting therefrom are sized to engage the material of the cabinet wall at the top and bottom of the elongated recess.

The elongated support plate serves to distribute forces along a significant area of the cabinet wall, including any forces resulting from "bend back" of the cabinet door from its normal maximum open position.

What is claimed is:

1. Apparatus for hingedly connecting a cabinet door to a cabinet wall of a frameless cabinet, said cabinet wall including spaced wall sides and a wall front extending between said spaced wall sides, said cabinet wall defining an opening at said wall front and an elongated recess extending inwardly from said opening into said cabinet wall between said wall sides, said apparatus comprising, in combination:

a first hinge member for attachment to a cabinet door;

a second hinge member pivotally connected to said first hinge member;

a double-ended, elongated support plate attached to said second hinge member at one of the ends of said elongated support plate for positioning through an opening in the wall front of a cabinet wall of a frameless cabinet into an elongated recess extending inwardly from the opening and between the wall sides of the cabinet wall, said elongated support plate having a support plate top and a support plate bottom and for distributing forces over a predetermined area of a cabinet wall; and at least one projection attached to said elongated support plate for frictionally engaging the cabinet wall when said elongated support plate is in the elongated recess of the cabinet wall to attach said second hinge member to the cabinet wall, said at least one projection comprising an elongated rib projecting from a side of said elongated support plate for positioning in an elongated slot formed in the cabinet wall communicating with the elongated recess, said elongated rib having a rib top and a rib bottom.

2. The apparatus according to claim 1 wherein said elongated rib is releasably connected to said elongated support plate.

3. The apparatus according to claim 2 wherein said elongated support plate defines an elongated aperture and wherein a portion of said elongated rib is disposed in said elongated aperture.

4. The apparatus according to claim 3 additionally comprising rib retention means for retaining said portion of said elongated rib in said elongated aperture.

5. The apparatus according to claim 4 wherein said rib retention means comprises at least one flange attached to said elongated rib engaging said elongated support plate, said elongated support plate having a depression adjacent to said elongated aperture for accommodating said at least one flange.

6. The apparatus according to claim 1 wherein a plurality of teeth are attached to said elongated rib and project outwardly from each of said rib top and said rib bottom.

7. The apparatus according to claim 6 wherein said teeth are angularly disposed to facilitate insertion of the elongated support plate and elongated rib respectively into the elongated recess and elongated slot of the cabinet wall and to grip the cabinet wall to resist removal of the elongated support plate from the elongated recess and resist removal of the elongated rib from the elongated slot.

8. The apparatus according to claim 1 additionally comprising a cover plate and connector means for connecting said cover plate to said elongated rib when said elongated rib is in the slot of a cabinet wall to cover the elongated slot.

9. The apparatus according to claim 8 wherein said elongated rib defines at least one opening, said connector means comprising a connector pin positionable in said opening and frictionally engageable with said elongated rib.

10. In combination:

a cabinet wall of a frameless cabinet, said cabinet wall including spaced wall sides and a wall front extending between said spaced wall sides, said cabinet wall defining an opening at said wall front and an elongated recess extending inwardly from said opening into said cabinet wall between said wall sides, an elongated slot formed in said cabinet wall communicating with said recess; and apparatus for hingedly connecting a cabinet door to the apparatus cabinet wall including a first hinge member for attachment to a cabinet door, a second hinge member pivotally connected to said first hinge member, a double-ended, elongated support plate attached to said second hinge member at one of the ends of said elongated support plate positioned through the opening in the wall front of said cabinet wall and in the elongated recess extending inwardly from the opening and between the wall sides of the cabinet wall, said elongated support plate having a support plate top and a support plate bottom and for distributing forces over a predetermined area of said cabinet wall; and at least one projection attached to said elongated support plate frictionally engaging the cabinet wall attaching said second hinge member to the cabinet wall, said at least one projection comprising an elongated rib having a rib top and a rib bottom and projecting from a side of said elongated support plate.

11. The combination according to claim 10 wherein a plurality of teeth are attached to said elongated rib and project outwardly from each of said rib top and said rib bottom into engagement with the cabinet wall at said elongated slot.

* * * * *